United States Patent [19]

Boulanger et al.

[11] 4,237,351

[45] Dec. 2, 1980

[54] KEYBOARD APPARATUS

[75] Inventors: Henry J. Boulanger, Cumberland, R.I.; Richard E. Puccini, Taunton, Mass.

[73] Assignee: Texas Instruments Incorporated, Dallas, Tex.

[21] Appl. No.: 947,686

[22] Filed: Oct. 2, 1978

[51] Int. Cl.[3] ..... H01H 9/02

[52] U.S. Cl. ..... 200/5 A; 200/159 B; 200/293; 200/294

[58] Field of Search ..... 200/1 R, 5 R, 5 A, 159 B, 200/293, 294

[56] References Cited

U.S. PATENT DOCUMENTS

| | | | |
|---|---|---|---|
| 3,684,842 | 8/1972 | Boulanger | 200/5 R |
| 4,086,451 | 4/1978 | Boulanger | 200/5 A |

OTHER PUBLICATIONS

IBM Tech. Discl. Bull., vol. 19, No. 1, Jun. 1976, "Force Concentrator for Touch Sensitive Panel Using Snap-Action Switches".

*Primary Examiner*—J. V. Truhe
*Assistant Examiner*—Morris Ginsburg
*Attorney, Agent, or Firm*—James P. McAndrews; John A. Haug; Melvin Sharp

[57] ABSTRACT

A keyboard has domed switch elements and complementary switch contacts which are mounted in an inexpensive housing formed of a very thin, flexible, electrically insulating sheet material. The housing is shaped by vacuum-forming to have flexible webs of the sheet material extending between relatively more rigid cup-shaped embossments formed in the sheet material. The webs and cupped embossments engage the domed switch elements and complementary contacts and normally hold the switch elements in open circuit positions relative to the contacts. However, flexing of the housing webs permits the domed switch elements to be selectively deflected to closed circuit positions engaging the contacts. Additional rigid embossments are formed in the thin housing material and are located over the domed elements to assist in deflecting the elements to their closed circuit positions. A keytop is also shaped from a thin sheet material by vacuum-forming to have flexible webs which extend between key embossments. The key top embossments are marked with suitable indicia and are nested over and rested on the additional rigid embossments of the housing which are formed over the domed elements, whereby pressure applied to a key top embossment deflects a corresponding domed switch element to its closed circuit position within the housing.

14 Claims, 12 Drawing Figures

KEYBOARD APPARATUS

In various conventional keyboards, a plurality of domed, electrically conductive switch elements are mounted in a pattern on a housing or support so that each domed element is located over a complementary, electrically conductive contact. The contacts and domed elements are connected to appropriate circuit conductors and each domed element is adapted to be deflected by a key to move individually and with snap action to an inverted domed configuration, thereby to engage the underlying contact for closing a circuit. The snap acting movement of the domed element provides a tactile response at the key to indicate closing of the circuit. Such keyboards have been widely used in hand-held electronic calculators and in other similar devices and have been very advantageous in providing a large number of key switches in a compact, reliable way at very low cost. However, there have also been many other potential keyboard applications, particularly those involving full alphanumeric keyboards and the like, where relatively large area keyboards have been required and where the cost of keyboard materials, and assembly costs for the keyboards, have tended to restrict practical commercial use of the keyboards. It would be very desirable if large keyboards capable of providing the noted tactile response could be manufactured at lower cost so that they would be economically practical for many additional uses, particularly those involving full alphanumeric keyboards.

It is an object of this invention to provide a novel and improved keyboard apparatus; to provide such an apparatus which is reliable in operation and which provides a tactile response at each key indicating when the key has been operated to close a keyboard circuit; to provide such an apparatus which is of a compact, lightweight nature but which is particularly adapted to incorporate a large number of key switch stations on a keyboard of substantial area; and to provide such an improved apparatus which is characterized by substantially improved material and manufacturing costs such that the apparatus is commercially practical for use in a wide variety of large-area keyboard applications.

The novel and improved keyboard apparatus of this invention preferably comprises a keyswitch assembly, an improved low cost keytop, and support means which mount the assembly for novel cooperation with the keytop.

The keyswitch assembly includes a plurality of switch members each of which preferably has a number of domed switch elements secured together in a row by carrier portions of the member. Each domed switch element is arranged to be individually deflectable with snap action from an original domed configuration to an inverted domed configuration when force is applied to the element. The assembly also includes a plurality of electrically conductive contact wires and buss wires and a pair of very inexpensive housing shells. The housing shells are shaped from a thin, flexible, electrically insulating sheet material by vacuum-forming or the like so that each shell has flat, flexible webs of the sheet material extending in a plane and also has relatively more rigid, cupped or embossed portions of the sheet material located in a pattern to stand up out of the plane.

In making the keyboard assembly, the contact wires and buss wires are placed on one of the housing shells to rest on webs of the housing material so that the rigid cupped embossments of the shell fit up between the wires to locate the wires in spaced side-by-side parallel relation to each other extending in one direction across the shell. The switch members are disposed on the shell to rest on top of the cupped embossments so that the members extend in spaced side-by-side relation to each other in another direction across the shell. In the desired arrangement, the switch members pass transversely over the contact and buss wires at a level above the contact wires. Each switch member is connected to a respective one of the buss wires and the domed switch elements are located so that they are disposed over respective, different contact wires. The second housing shell is secured to the first shell to normally hold the switch members and wires in the described relationship to each other. That is, the second shell is positioned so that webs and embossments of the second shell engage the switch members and wires and normally hold the domed switch elements in open circuit positions spaced over complementary contact wires. The flexible webs of the housing are then movable from outside the housing to permit the domed switch elements to be deflected to their inverted domed configurations wherein they engage the underlying, complementary contact wires, thereby to close circuits between the contact wires and selected buss wires.

Preferably other rigid embossments on the housing are located over each of the domed switch elements to extend out from the housing so that pressure applied to those embossments is effective to move flexible webs of the housing and to actuate or deflect the individual domed switch elements to their closed circuit positions.

The improved key top of this invention preferably comprises a thin flexible sheet material which is also preferably shaped by vacuum-forming or the like so that cup-shaped embossments stand up from flexible web portions of the key top sheet. The embossments are marked with suitable indicia and the key top is mounted over the keyswitch assembly by a suitable bezel or other support means so that the keytop embossments fit over and rest on the actuating embossments of the second shell of the housing. The webs of the keytop are spaced slightly from corresponding webs of the keyswitch assembly housing. In that arrangement, manual pressure applied to each keytop embossment is effective to deflect a selected domed switch element to a closed circuit position and also to provide a tactile response at the keytop embossment indicating the closing of the circuit. In this way a very low cost, reliable, compact, and light weight keyboard is achieved which is economically practical for use in a full alphanumeric keyboard for many new applications.

Other objects, advantages, and details of the novel and improved keyboard apparatus of this invention appear in the following detailed description of preferred embodiments of the invention, the detailed description referring to the drawings in which.

Figure 1:
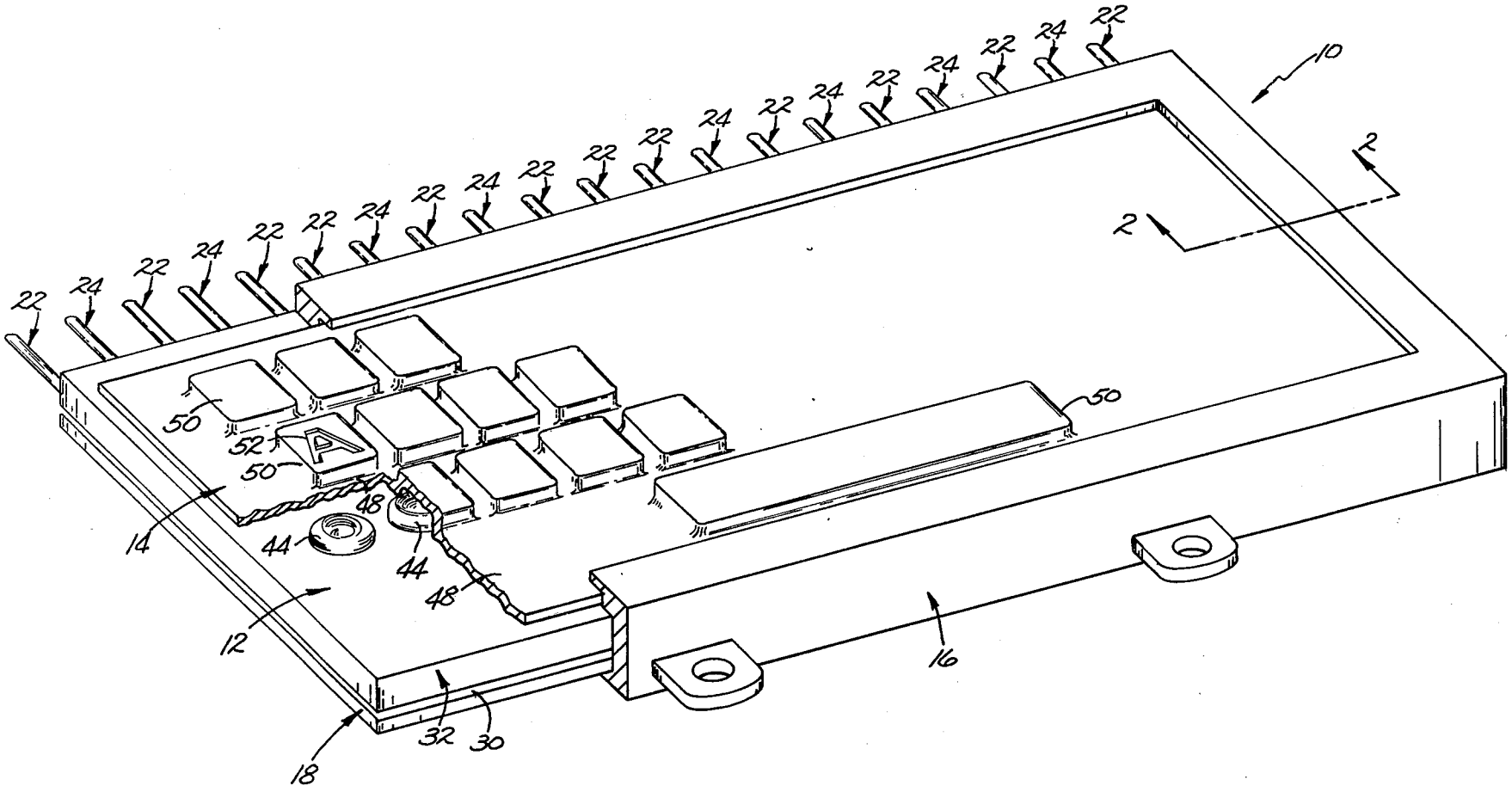
FIG. 1 is a perspective view of the keyboard apparatus of this invention showing the apparatus partially cut away to illustrate the interaction of a keytop, bezel and keyswitch assembly within the apparatus.
Figure 2:
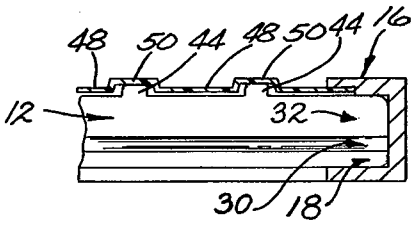
FIG. 2 is a partial section view to enlarged scale along line 2—2 of FIG. 1.

Referring to the drawings, 10 in FIGS. 1 and 2 indicates the novel and improved keyboard apparatus of this invention which is shown to include a keyswitch assembly 12 and a keytop 14. A bezel or other support 16 positions the keytop and keyswitch assembly relative to each other. The keyboard apparatus typically provides a full alphanumeric keyboard or the like of substantial surface area such as is commonly used on a typewriter or data entry terminal as shown in FIG. 1. The keyswitch assembly 12 is preferably mounted against a flat, rigid support surface 18 such as may be provided by a plate of fiberboard as shown in FIG. 2 or may be provided by the support 16 or in other convenient manner.

The key switch assembly 12 shown in FIGS. 3–11 preferably includes a housing 20, a plurality of electrically conductive contact wires 22, a plurality of electrically conductive buss wires 24, and a plurality of electrically conductive switch members 26 each of which incorporates one or more domed switch elements 26.1. The housing mounts the switch members 26 to extend over the contact wires 22 so that keyswitch stations 28 are formed at each location where a switch member crosses over an individual contact wire 22 as is diagrammatically illustrated in FIG. 3.

Figure 4:
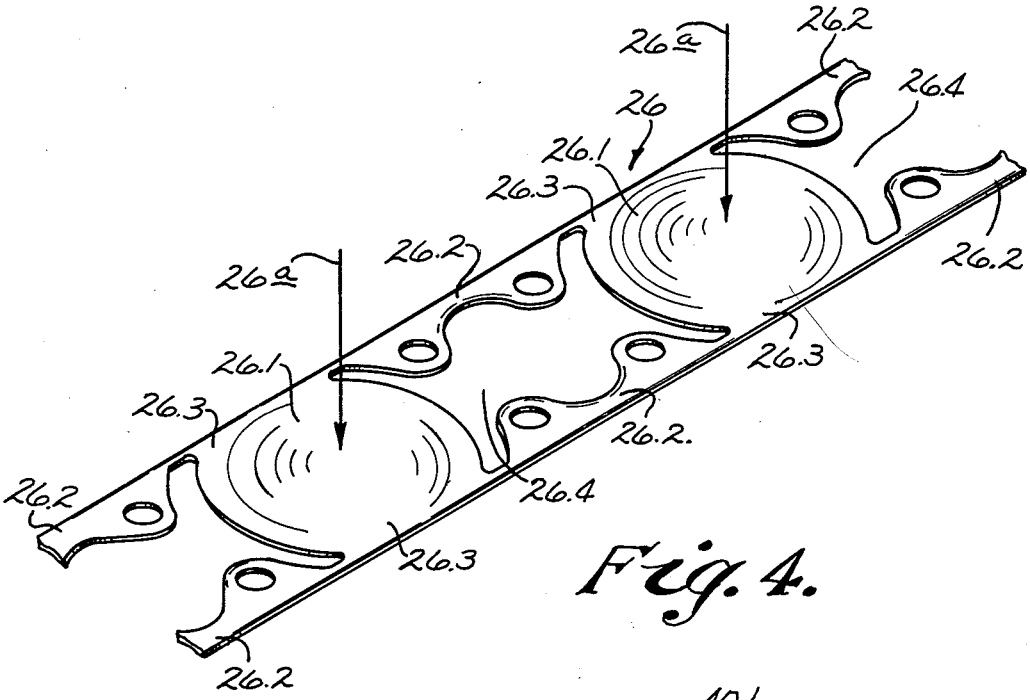
FIG. 4 is a perspective view of one of the components used in the keyswitch assembly of FIG. 3.

In accordance with this invention, the contact wires 22 and the buss wires 24 are inexpensive and typically comprise generally straight lengths of round copper alloy wire or the like. The switch members 26 are more complex but are also adapted to be inexpensively made. Thus each switch member 26 preferably incorporates a plurality of domed switch elements 26.1 which are secured together in a row by carrier portions 26.2 of the member as shown in FIG. 4. Each domed element 26.1 comprises a segment of a sphere or the like which is connected to the carrier portions 26.2 at selected locations 26.3 but which are separated from the carrier portions at other locations by the openings 26.4 in the member. Each domed switch element 26.1 is adapted to move individually and with snap action from its original domed configuration as shown in FIG. 4 to an inverted domed configuration when a force *26a* is applied to the domed element. The element then returns to its original domed configuration with snap action when the force *26a* is removed. As such switch members 26 having a plurality of individually-deflectable domed switch elements 26.1 are known and are illustrated and described in U.S. Pat. No. 4,005,293, the members are not further described herein and it will be understood that the members are adapted to be repetitively manufactured in strip form at low cost and to be cut into lengths incorporating any desired number of the domed switch elements 26.1 in each member.

In accordance with this invention, the housing 20 of the keyswitch assembly 12 is also of very inexpensive structure. Typically the housing comprises a pair of shells 30 and 32. See FIG. 5. The shells are shaped by vacuum-forming or the like from a thin, flexible, electrically insulating sheet material polyethylene, polyvinyl chloride, or polycarbonate or the like preferably having a thickness in the range from about 0.005 to 0.032 inches so that each shell has flexible webs formed by generally flat portions of the sheet material and also has relatively more rigid portions formed by cup-shaped embossments or the like provided in the thin sheet material.

Figure 5:
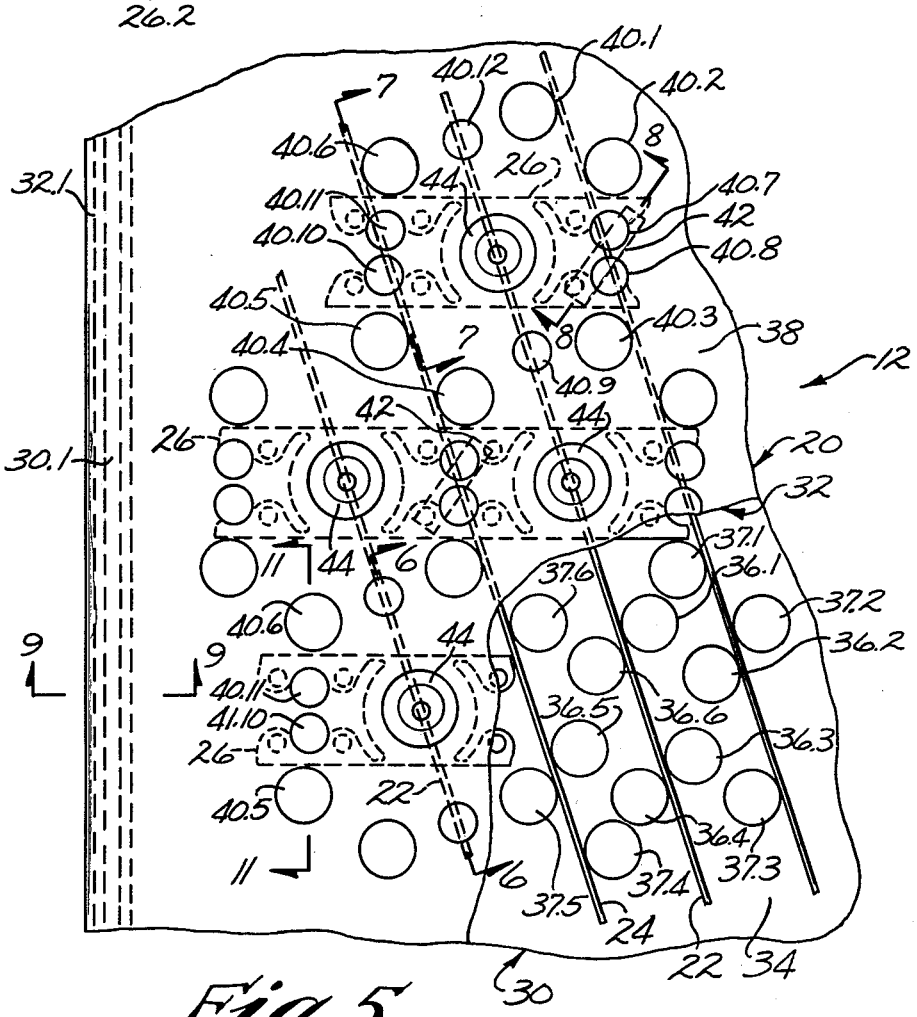
FIG. 5 is a partial plan view to enlarged scale of the keyswitch assembly of FIG. 1 showing the assembly partially cut away to illustrate various steps in construction of the assembly.

In a preferred embodiment of the invention as shown in FIG. 5 for example, the first or bottom housing shell 30 is vacuum-formed from a sheet of clear, polycarbonate 0.010 inches thick so that the shell has flat flexible webs 34 extending in a common plane and has relatively more rigid cup-shaped embossments 36 (one of which is shown partly cut away in FIG. 8) which extend up out of the plane. The embossments 36 are preferably flat-topped and are of a diameter of about 0.125 inches and a height of 0.060 inches. The embossments are arranged in a pattern across the shell so that a grouping of the embossments is repeated at each of the keystations 28. Preferably for example a group of embossments 36.1–36.6 is arranged generally in an inner ring at each of the keyswitch stations 28. Other embossments 37.1–37.6 cooperate to form a second, concentric, outer ring of embossments at each of the keystations. Typically the shell 30 is also formed with a flange 30.1 around the sides of the shell.

Figure 9:
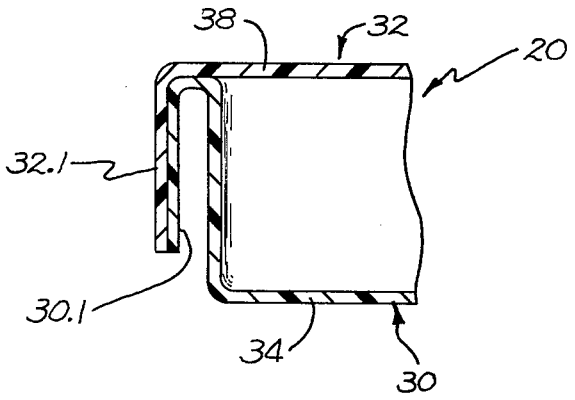
FIG. 9 is a partial section view to enlarged scale along line 9—9 of FIG. 5.
Figure 10:
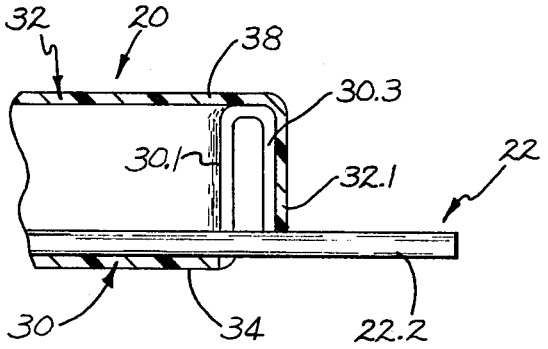
FIG. 10 is a section view to enlarged scale along line 10—10 of FIG. 3.

The housing 32 is preferably formed in a similar way from similar material to be secured to the shell 30 to form the housing 20. Preferably, as shown in FIG. 5 for example, the shell 32 is provided with flat flexible webs 38 and with relatively more rigid cup-shaped embossments 40 as shown in FIG. 5. The embossments 40 are also preferably arranged in a pattern so that a group of the embossments 40 is repeated at each of the keystations 28. In a preferred embodiment of the invention, six embossments 40.1–40.6 have a size and ring spacing corresponding to that of the embossments 37.1–37.6 on the first shell 30. Six smaller embossments 40.7–40.12 are spaced around the same ring, as shown in FIG. 5. Preferably the shell 32 also has a rim flange 32.1 which is adapted to mesh with the rim 30.1 on the first shell as is shown in FIG. 9 or in other convenient manner.

Figure 3:
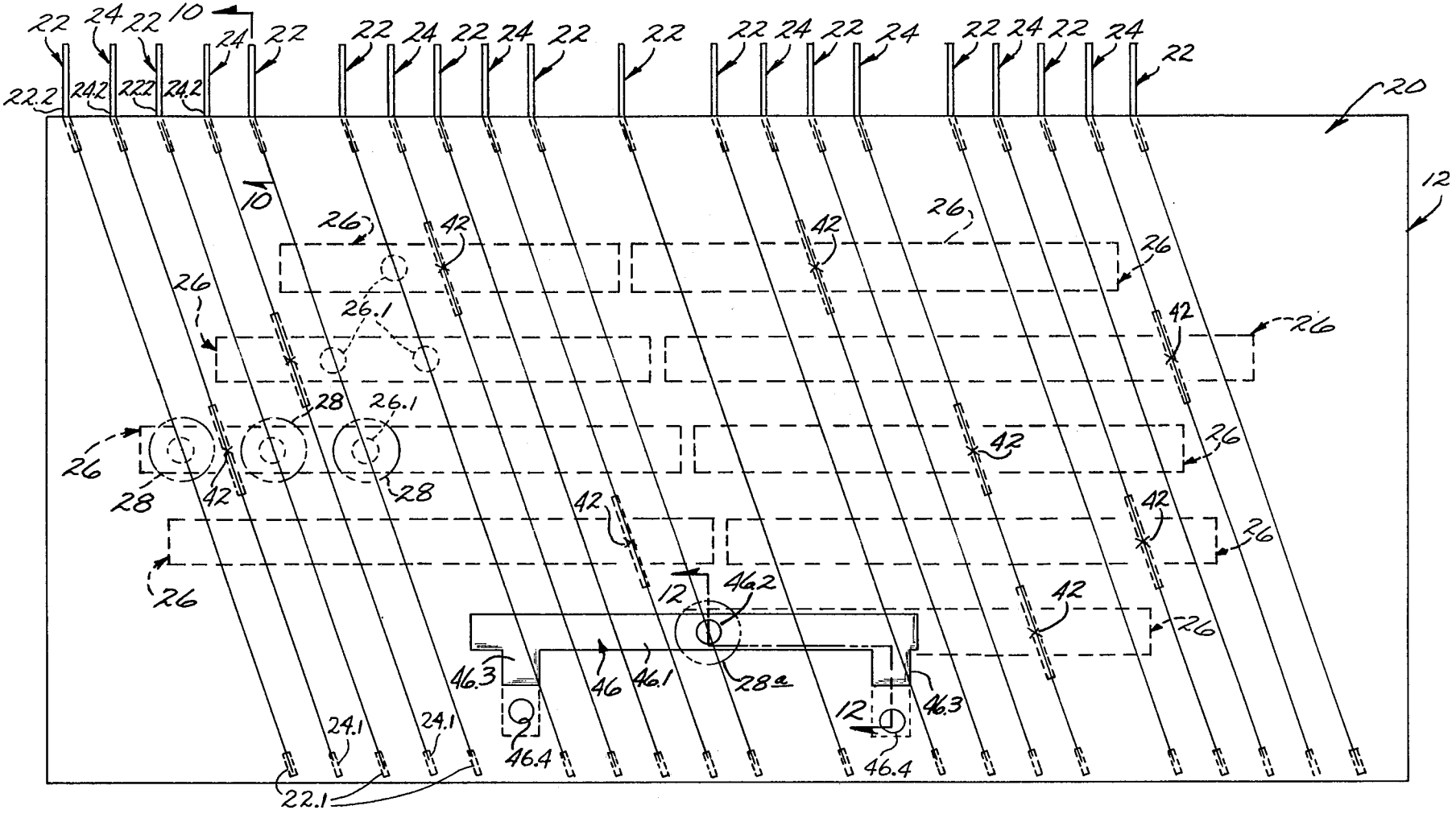
FIG. 3 is a diagrammatic plan view of the keyswitch assembly used in the apparatus of FIG. 1 illustrating the relative location of various components in the keyswitch assembly.

In assembling the key switch assembly 12 according to this invention, the contact wires 22 and the buss wires 24 are placed on the shell 30 to rest on the flexible webs 34 so that the relatively more rigid embossments 36 and 37 fit up between the wires to locate the wires in spaced, side-by-side parallel relation to each other extending in one direction across the shell. The contact and buss wires are preferably arranged in alternate relation to each other on the shell 30. Preferably the contact wires pass between embossments 36.1 and 36.6 and between embossments 36.3 and 36.4 at each keystation 28 so that the contact wire passes centrally through each key station. The buss wires 24 preferably extend between other pairs of the embossments 36 or 37 to pass across the shell 30 at locations between the key stations 28 as shown in FIG. 3. Preferably the lengths of the contact and buss wires are selected so that the wires abut the shell flange 30.1 at one end 22.1 and 24.1 of the wires (see FIG. 5) and so that the opposite ends 22.2 and 24.2 of the wires extend from the housing through slots 30.3 (see FIGS. 5 and 10) in the flange of the bottom shell to be connected in an electrical circuit as is further discussed below. If desired the flange 30.1 is fused to shell 32 to abut the ends 22.1 and 24.1 of the wires for further holding the wires in place.

The switch members 26 are then disposed on the shell 30 on top of the relatively rigid embossments 36 so that the switch members extend in spaced side-by-side relation to each other in a second direction across the shell and are supported by the embossments 36 to pass transversely over the contact wires 22 and buss wires 24 at a level spaced above the wires. Each switch member 26 is electrically connected to a selected buss wire 24 and the domed switch elements 26.1 of the members are disposed at the respective key stations 28 in spaced, overlying relation to the contact wires 22 which pass centrally through those keystations as noted above. In that arrangement, each domed switch element 26.1 is located at a keystation in an open circuit position relative to an underlying contact wire 22. However, the element is adapted to be deflected to an inverted domed configuration to engage the contact wire underlying the domed element, thereby to close a circuit between the contact wire and a selected buss wire in the keyswitch assembly 12.

Figure 6:
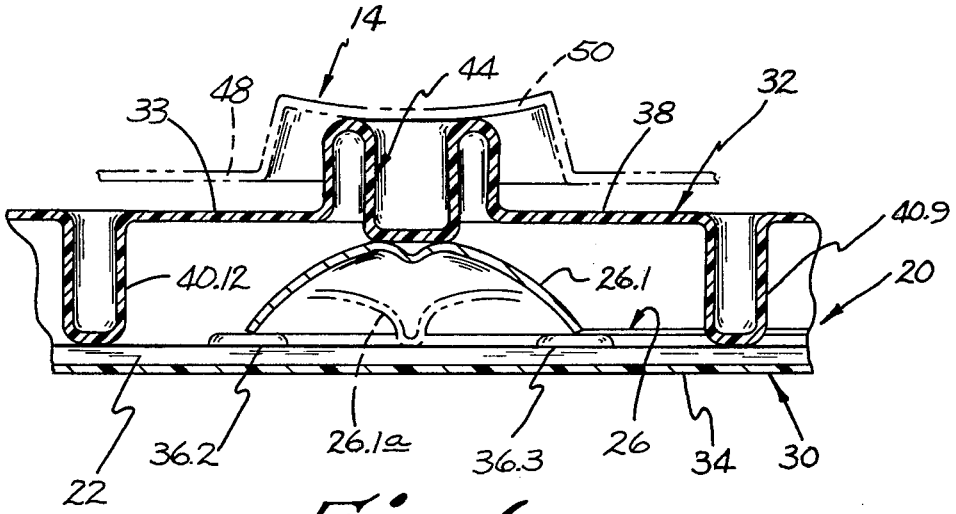
FIG. 6 is a partial section view to enlarged scale along line 6—6 of FIG. 5.
Figure 8:
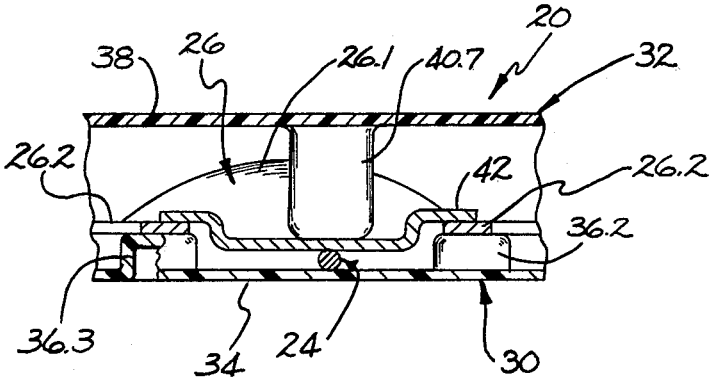
FIG. 8 is a partial section view to enlarged scale along line 8—8 of FIG. 5.

In a preferred embodiment of this invention, for example, short generally U-shaped electrically conductive jumper strips 42 are positioned between the switch members 26 and the respective buss wires 24 nesting in opening 26.4 in the switch member as is shown in FIGS. 3, 5 and 8 for electrically connecting the members to the buss wires. Each domed switch element 26.1 is arranged to rest on the inner ring of embossments 36.1–36.6 at a keystation 28 as is illustrated in FIGS. 5 and 6. In that arrangement, the domed element 26.1 is securely supported in spaced relation to the contact wire 22 passing through the key station 28 but is adapted to be deflected into an inverted domed configuration to fit down within the inner ring of the embossments 36 to engage the contact wire 22 as is indicated by the broken lines 26.1*a* in FIG. 6.

The second housing shell 32 is then secured to the shell 30 so that portions of the second shell also engage electrically conductive components of the keyswitch assembly for holding those components in the assembled relation described above. That is, the second shell is positioned to normally hold the domed switch elements 26.1 in open circuit position relative to contact wires 22 as described above but to permit deflecting of the domed switch elements to their closed circuit positions.

Figure 7:
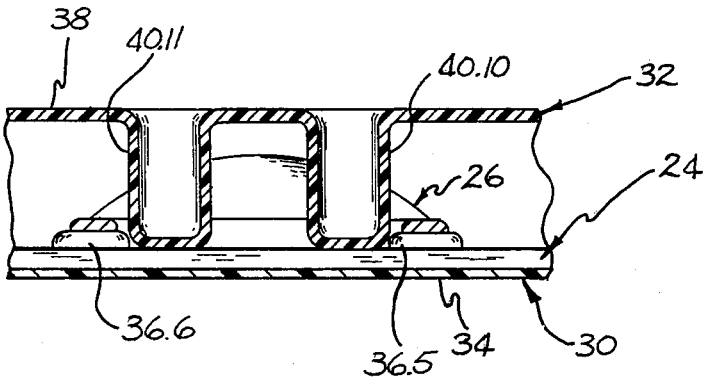
FIG. 7 is a partial section view to enlarged scale along line 7—7 of FIG. 5.
Figure 11:
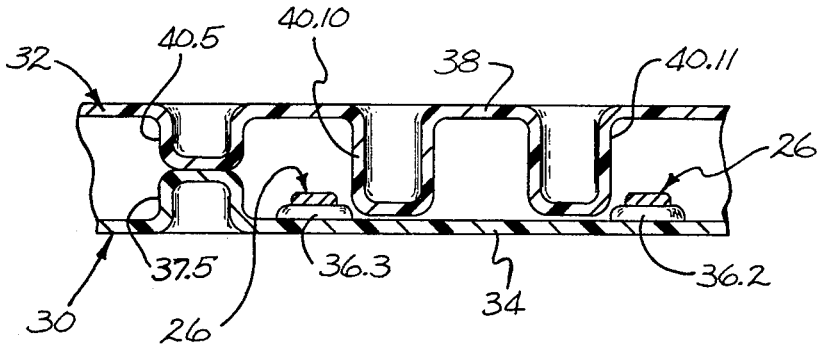
FIG. 11 is a section view to enlarged scale along line 11—11 of FIG. 5.
Figure 12:
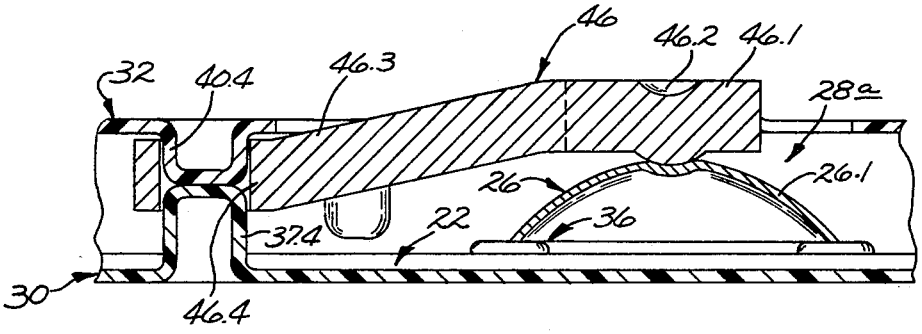
FIG. 12 is a section view to enlarged scale along line 12—12 of FIG. 3.

In a preferred embodiment of this invention, for example, embossments 40.1–40.6 of the second shell have selected proportions and are secured to corresponding spaced embossments 37.1–37.6 of the first shell 30 by ultrasonic bonding, heat-sealing, cementing or in other conventional manner as is shown in FIGS. 5 and 11. The second shell is located so that areas of the second shell lie against the domed switch elements 26.1 to hold those elements against the embossments 36 on the first shell as is seen in FIG. 6. The shell embossments 40.9 and 40.12 bear against contact wires 22 at or adjacent to the keystations 28 as shown in FIG. 6 to hold the wires securely against the webs 34 of the first shell and to firmly position the wires between the selected embossments 36 on the first shell. The embossments 40.7–40.8 and 40.10–40.11 then bear against the buss wires 24 for securely positioning the buss wires on the first shell as is seen in FIGS. 5 and 7. The embossments 40.7–40.8 and 40.10–40.11 fit through the openings 26.4 in the switch members and therefore secure the switch members against lateral movement on the shell 30. The location of the heat-sealed embossments 40.1–40.6 also serve to prevent such lateral movement of the switch member as will be understood. In some of the locations, the shell embossments 40.7–40.8 or 40.10–40.11 bear against jumper strips 42 as shown in FIG. 8 for holding the jumper strips in position to electrically connect selected switch members 26 to selected buss wires 24.

In that arrangement, the housing shells 30 and 32 normally cooperate to mount the contact and buss wires and the switch members 26 in open circuit positions at each of the keystations 28. Accordingly, when the ends 22.2 and 24.2 of the contact and buss wires are connected into an electrical circuit in a conventional manner, open circuit keyswitches are located at each of the keystations 28 in the keyswitch assembly 12. However, the flexible webs 38 of the second shell are movable such that pressure applied to any of the domed switch elements 26.1 through the shell 32 is adapted to move a flexible web portion 38 of that shell to deflect the domed element 26.1 with snap action to its closed circuit position, thereby to close a circuit between one of the buss wires and one of the contact wires in the keyswitch assembly. The bonding of the embossments 40.1–40.6 to corresponding embossments 37 in a ring at each key station 28 effectively isolates the selected flexing of the webs 38 at one key station from the domed switch element 26.1 at the other key stations 28. Thus the keyswitch assembly is formed of a very inexpensive materials and components which are very easily assembled as noted above. However, the assembly is adapted to provide any desired number of keyswitches 28 over a wide keyboard surface. The keyswitch assembly is reliable and compact and of light weight and the snap-acting movement of the domed switch elements 26.1 on closing a keyswitch circuit is adapted to provide a tactile response at the keyswitch station to indicate that the circuit is being closed.

In one preferred embodiment of this invention, the housing shell 32 also has additional embossments 44 which are preferably of a double-cupped configuration as shown in FIG. 6 to provide the additional embossments with even greater rigidity while also permitting vacuum forming of the embossments 44 in an inexpensive manner. The additional embossments are arranged so that, when the shells 30 and 32 are secured together as described above, the embossments 44 are disposed over the respective domed switch elements 26.1 and extend outwardly from the keyswitch assembly housing 20. The additional embossments are each adapted to be individually depressed by the application of pressure to the embossment for flexing the web portions 38 adjacent to the embossment and for selectively deflecting the underlying domed switch element 26.1 to its closed circuit position. That is, the additional embossments have a rigidity and location which facilitates selective deflection of the individual domed switch elements.

In a preferred embodiment of this invention, the keyswitch assembly 12 also preferably includes a novel space bar or key arrangement wherein a space bar 46 is mounted on the vacuum-formed housing 20 to extend over a selected keyswitch station 28*a* to permit closing of the circuit at that keyswitch station in a more convenient manner. Preferably, for example, the space bar has a flat key portion 46.1 which is preferably dimpled at 46.2 over the domed switch element 26.1 located in the housing 20 at the keystation 28*a*. The bar has arms 46.3 adjacent its opposite ends, has apertures 46.4 at the ends of those arms, and has a bend in each arm disposing the arm ends at a level below the level of the key portion 46.1 of the bar. The space bar 46 has its arms fitted through an aperture in the shell 32, has the arm apertures 46.4 disposed over selected embossments 37.4 on the shell 30, and has embossments 40.4 from the shell 32 heat-sealed to those embossments 37.4 for locking the arm apertures on those embossments. In that arrangement the space bar 46 is of inexpensive manufacture and is easily assembled in the keyswitch assembly 12 with the space bar dimple located to depress the additional switch element 26.1 for closing a circuit at the keystation 28*a*.

In accordance with this invention, the keyboard apparatus 10 also preferably includes the novel keytop 14 as shown in FIGS. 1 and 2. The keytop is preferably shaped from a thin, flexible sheet of organic plastic material such as polyethylene, polyvinyl chloride or polycarbonate or the like by vacuum-forming or in other conventional manner so that flat, flexible web portions 48 of the keytop are disposed in a plane connecting cup-shaped key embossments 50. Typically for example the keytop 14 is shaped by vacuum-forming from a white colored polycarbonate sheet having a thickness of about 0.010 inches to provide embossments 50 out 0.500 inches square and about 0.040 inches deep. Appropriate indicia 52 (see FIG. 1) are applied either to the top or the reverse side of the keytop embossments 50 by screen printing or in other conventional manner so that the indicia are visible from the top of the embossments.

In the preferred embodiment of this invention, the keytop 14 is captured by a bezel or support means 16 over the keyswitch assembly 12 so that the keytop embossments 50 are nested over and rested on the rigid, actuating embossments 44 formed in the second housing shell 32. The keytop 14 is proportioned so that when the keytop embossments 50 rest on the housing shell embossments 44, the webs 48 of the keytop are slightly spaced from the housing. See FIGS. 2 and 6. In that arrangement, manual pressure applied to a selected keytop embossment 50 by a keyboard operator flexes the adjacent keytop web material 48 and depresses a selected housing embossment 44 to deflect a domed switch element 26.1 to closed circuit position with snap action as described above. The tactile response provided by the snap action of the movement of the domed element 26.1 to its closed circuit position is transmitted freely to the selected keytop embossment 50 to indicate to the operator that a selected circuit has been closed.

In this way the objects of the present invention are accomplished. The keyboard 10 is adapted for reliable operation and is also adapted to be used in large are keyboard applications with low material and manufacturing costs.

It should be understood that although preferred embodiments of this invention have been described by way of illustrating this invention, the invention includes all modifications and equivalents of the described embodiments falling within the scope of the appended claims.

We claim:

1. A switch assembly comprising electrically conductive switch members mounted on housing means to permit relative movement of a pair of the members between an open circuit position in which the members of the pair are spaced from each other and a closec circuit position in which the members of the pair are engaged with each other, characterized in that the housing means comprises thin, flexible, electrically insulating sheet material which is of substantially uniform material thickness throughout its extent having substantially flat and relatively flexible web portions of the thin sheet material arranged to interconnect relatively more rigid cupped portions of the thin sheet material and having selected ones of said web and cupped portions of the sheet material engaging the switch members of the pair and cooperating to normally maintain the pair of members between said portions of the sheet material in one of said circuit positions while permitting selective flexing of web portions of the sheet material to cause selective movement of the pair of switch members to the other of said circuit positions.

2. A switch assembly as set forth in claim 1 wherein one of said cupped portions of the thin sheet material is arranged to be depressed to apply a force against one of the pair of switch members with flexing of selected ones of said web portions of the thin sheet material to cause said selective movement of the pair of switch members to said other circuit position.

3. A switch assembly as set forth in claim 1 wherein said pair of switch members comprises a first contact member and a domed switch member having a center portion and a peripheral portion, the domed switch member being deflectable between an open circuit position spaced from the first contact member and a closed circuit position engaging the first contact member, said housing means having selected ones of said web and cupped portions engaging the first contact member to hold the first contact member stationary and having selected ones of said cupped portions engaging the peripheral portion of the domed switch member to normally maintain the domed switch member in said open circuit position spaced from the first contact member, the housing means having a selected one of said housing portions arranged to be depressed against the center portion of the domed switch member with flexing of selected ones of the web portions of the thin sheet material to deflect the domed switch member to said closed circuit position.

4. A switch assembly as set forth in claim 1 having a plurality of said pairs of said electrically conductive switch members mounted on said housing means in a selected pattern, each of said pairs of conductive members comprising a first contact member and a domed switch member deflectable between an open circuit position spaced from the first contact member and a closed circuit position engaging the first contact member, the housing means having selected ones of the web and cupped portions of the thin sheet material engaging the first contact members holding the first contact members stationary in said selected pattern and having selected ones of the cupped portions of the thin sheet material engaging the domed switch members to normally maintain the domed switch members in said open circuit positions thereof spaced from the respective first contact members while permitting flexing of selected ones of said web portions of the thin sheet material to cause selective, individual movement of the domed switch members to the closed circuit positions of the domed members.

5. A multiswitch keyboard assembly comprising a housing means, a plurality of first electrical contact members mounted on the housing means in spaced relation to each other in a selected pattern, a plurality of domed switch members each having a peripheral portion and a center portion, the domed switch members being mounted on the housing means to be selectively deflectable between open circuit positions in which the domed switch members are spaced from respective first contact members and closed circuit positions in which the domed switch members are engaged with respective first contact members characterized in that the housing means comprises thin flexible, electrically insulating sheet material which is of substantially uniform material thickness throughout the extent of the sheet material, the material of the housing means having substantially flat and relatively flexible web portions of the thin sheet material interconnecting relatively more rigid cupped portions of the thin sheet material, the housing means having selected ones of said web and cupped portions of the sheet material engaging the first contact members and cooperating to hold the first contact members stationary therebetween in said selected pattern, having selected ones of said cupped portions of the sheet material engaging said peripheral portions of the domed switch members to normally maintain the domed switch members in said open circuit positions spaced from the first contact members, and having other selected ones of said portions of the sheet material engaging respective center portions of the domed switch members to be selectively depressed with flexing of selected ones of the web portions of the sheet material to move the domed switch members individually to their closed circuit positions.

6. A keyboard assembly as set forth in claim 5 wherein said housing means comprises a pair of shells of said thin, flexible, electrically insulating sheet material, said shells being secured together for mounting said first contact members and said domed switch members therebetween for said selective movement between said circuit positions.

7. A keyboard assembly as set forth in claim 6 wherein said sheet material comprises a material selected from the group consisting of polyethylene, polyvinyl chloride or polycarbonate having a sheet material thickness in the range from 0.010 to 0.032 inches.

8. A multiswitch keyboard assembly comprising housing means, a plurality of electrically conductive wire elements mounted on the housing means in spaced side-by-side relation to each other in a selected pattern, and a plurality of electrically conductive actuating members each embodying a plurality of domed switch members secured together in a row by carried strip portions of the actuating member so that each domed switch member is individually deflectable with snap action from an original domed configuration to an inverted domed configuration in response to the application of force to the domed switch member, said actuating members being mounted on the housing means in spaced side-by-side relation to each other electrically connected to respective selected ones of said wire elements so that the domed switch members are disposed in their original domed configurations in open circuit positions over other respective wire elements spaced from the other wire elements to be deflectable to said inverted domed configurations to be moved to closed circuit positions engaging said respective other wire elements, characterized in that the housing means comprise a pair of shells of thin, flexible, electrically insulating sheet material which is of substantially uniform material thickness throughout the extent of the sheet material, said shells each having substantially flat and relatively flexible web portions of the thin sheet material interconnecting relatively more rigid cupped portions of the thin sheet material, said shells being secured together with cupped and web portions of the shells engaging said wire elements to hold said elements stationary in said pattern in said spaced relation to each other and with cupped portions of the shells engaging the actuating members to normally maintain said domed switch members in said open circuit positions while permitting selective flexing of web portions of the shell material to selectively move the individual domed switch members to said closed circuit position thereof.

9. A keyboard assembly as set forth in claim 8 wherein one of said shells has cupped portions thereof extending between said conductive wire elements for spacing said wire elements in side-by-side relation to each other, said actuating members being disposed on said cupped portions of said one shell for disposing said domed switch members in said open circuit position thereof, the other of said shells having cupped portions thereof engaging said conductive wire elements for holding said wire elements stationary against said one shell, having cupped portions engaging said actuating members for holding the actuating members in said spaced relation to each other, and having cupped portions engaging the respective domed switch members to be selectively depressed against the domed switch members with flexing of web portions of the other of said shells for selectively moving the domed switch members to said closed circuit positions thereof.

10. A switch assembly as set forth in claim 6 having space bar means mounted on said housing means for selectively moving one of said domed switch members to said closed circuit position thereof characterized in that, said space bar means comprises a rigid space bar member having a pair of eylet-like arm means each having an aperture and extending from the space bar member at spaced locations along the space bar member, the housing means having a pair of cupped portions of the thin sheet material extending from at least one of the shells through the apertures in the respective eyelet-like arm means and secured to the other of said shells for mounting the space bar means in engagement with the center portion of one of said domed switch members to be pivotally movable for depressing the center portion of said domed switch member to move said one domed switch member to said closed position thereof.

11. A keyboard assembly as set forth in claim 5 having rigid substrate means supporting said housing means thereon.

12. A keyboard assembly as set forth in claim 6 having a plurality of said relatively rigid cupped portions of one of said shells bonded to the other of said shells at locations spaced to surround each of said domed switch members in ring configurations around the respective domed members for securing said shells together, whereby flexing of selected web portions of one of the shells within any one of said ring formations for deflecting one domed switch member to the closed circuit position thereof is substantially isolated from the other web portions of said one shell outside of said one ring formation.

13. A keyboard apparatus comprising a keyswitch assembly having a plurality of pairs of electrically conductive switch members mounted in a selected pattern on housing means to permit relative movement of each pair of the members between an open circuit position in which the members of the pair are spaced from each other and a closed circuit position in which the members of the pair are engaged with each other, said housing means being formed of thin, flexible, electrically insulating sheet material of substantially uniform thickness throughout its extent having substantially flat and relatively flexible web portions of the thin sheet material arranged to interconnect relatively more rigid cupped portions of the thin sheet material, having selected cupped portions of said thin sheet material engaged with the switch members to normally maintain the members in one of said circuit positions while permitting selective flexing of web portions of the thin sheet material to cause selective movement of switch members to the other of said circuit positions, and having additional cupped portions of the thin sheet material extending out from the housing means arranged to be depressed against respective switch members with flexing of web portions of the thin sheet material to cause said selective movement of the switch members; and a keytop comprising a thin flexible, sheet material of substantially uniform thickness having substantially flat and relatively flexible web portions of said thin sheet material arranged to interconnect relatively more rigid keyshaped embossments formed in the sheet material, said keytop being supported over said keyswitch assembly with said keytop embossments nested over and rested on said respective additional cupped portions of said housing means, whereby manual pressure applied to a selected keytop embossment is effective to cause said relative movement of one of said switch member pairs to said closed circuit position thereof. 14.

14. A keyboard apparatus as set forth in claim 13 wherein each of said pairs of switch members comprises a first contact and an element having an original domed configuration which is normally disposed in an open circuit position spaced from the first contact and which is delfectable with snap action to an inverted domed configuration to move to a closed circuit position engaging the first contact in response to application of a selected force to the element, said keytop having said keytop embossments nested over and rested on said respective additional cupped portion of said housing means and having said flexible keytop web portion spaced from said housing means, whereby snap acting movement of one of said domed elements to said closed circuit position thereof in response to the application of manual pressure to a selected keytop embossment provides a tactile response at said keytop embossment to indicate movement of said one domed element to said closed circuit position.

* * * * *